US008251726B2

(12) United States Patent
Ma

(10) Patent No.: US 8,251,726 B2
(45) Date of Patent: Aug. 28, 2012

(54) ELECTRICAL CONNECTOR HAVING A METAL FRAME WITH LOCKING PORTIONS MOVABLE IN TRANSVERSE DIRECTION FOR LOCKING/UNLOCKING A CARD

(75) Inventor: Hao-Yun Ma, Tu-Cheng (TW)

(73) Assignee: Hon Hai Precision Ind. Co., Ltd., Taipei (TW)

( * ) Notice: Subject to any disclaimer, the term of this patent is extended or adjusted under 35 U.S.C. 154(b) by 251 days.

(21) Appl. No.: 12/786,452

(22) Filed: May 25, 2010

(65) Prior Publication Data

US 2010/0297865 A1 Nov. 25, 2010

(51) Int. Cl.
*H01R 13/62* (2006.01)

(52) U.S. Cl. ..... 439/326

(58) Field of Classification Search ..... 439/326, 439/325, 321, 327, 328, 376, 372
See application file for complete search history.

(56) References Cited

U.S. PATENT DOCUMENTS 4,433,886 A * 2/1984 Cassarly et al. ..... 439/65
5,415,573 A * 5/1995 Chen et al. ..... 439/876
5,484,302 A * 1/1996 Yamada et al. ..... 439/326
5,803,761 A 9/1998 Mochizuki
5,816,838 A * 10/1998 Del Prete et al. ..... 439/326
6,176,724 B1 * 1/2001 Klatt et al. ..... 439/326
6,626,685 B2 9/2003 Toda
7,270,559 B1 9/2007 Chen
7,328,843 B2 * 2/2008 Ko et al. ..... 235/441
7,976,327 B2 * 7/2011 Matsumoto et al. ..... 439/326
2008/0261424 A1 * 10/2008 Ting ..... 439/159
2010/0093200 A1 * 4/2010 Ye et al. ..... 439/159

* cited by examiner

*Primary Examiner* — Chandrika Prasad
(74) *Attorney, Agent, or Firm* — Wei Te Chung; Andrew C. Cheng; Ming Chieh Chang

(57) ABSTRACT

An electrical connector for receiving a card includes an insulating housing, terminals and a metal frame attached to the housing. The housing includes a base having a terminal-location portion, a pair of sidewalls extending a first direction and a rear wall adjacent to the terminal-location portion. The terminals are arranged in the terminal-location portion along a second direction perpendicular to the first direction. The metal frame is attached to the housing and includes a base portion located above the terminal-location portion to define a receiving slot between the terminal-location portion and the base portion for receiving a mating end of the card, the base portion is not beyond the terminal-location portion in the first direction and the receiving. The metal frame further includes a pair of locking portions adapted for pressing against a top face of the card to lock the card in the insulating housing and moving outwards in the second direction to release the card.

11 Claims, 5 Drawing Sheets

ELECTRICAL CONNECTOR HAVING A METAL FRAME WITH LOCKING PORTIONS MOVABLE IN TRANSVERSE DIRECTION FOR LOCKING/UNLOCKING A CARD

BACKGROUND OF THE INVENTION

1. Field of the Invention

The present invention relates to an electrical connector for receiving a card-like component therein.

2. Description of the Related Art

Issued U.S. Pat. No. 7,270,559 disclose a conventional electrical connector adapted for receiving a card. The connector has a metal cover rotatably assembled on one end of the base with conductive terminals. The cover rotate downwards to the base and move to the pivot position along the horizontal direction to lack the cover with the base after the card is placed in the base or the cover. It is well known that it needs three steps to complete assembling of the card to the connector. Sometimes, said structure is believed complex.

In view of the above, a new electrical connector that overcomes the above-mentioned disadvantages is desired.

SUMMARY OF THE INVENTION

Accordingly, an object of the present invention is to provide an electrical connector which is facility for assembling of a card therein.

To fulfill the above-mentioned object, an electrical connector for receiving a card comprises an insulating housing, a plurality of terminals and a metal frame attached to the insulating housing. The insulating housing comprises a base having a terminal-location portion, a pair of sidewalls extending a first direction and a rear wall adjacent to the terminal-location portion. The terminals are arranged in the terminal-location portion along a second direction perpendicular to the first direction. The metal frame is attached to the insulating housing and comprises a base portion located above the terminal-location portion to define a receiving slot between the terminal-location portion and the base portion for receiving a mating end of the card, the base portion is not beyond the terminal-location portion in the first direction and the receiving. The metal frame further comprises a pair of locking portions adapted for pressing against a top face of the card to lock the card in the insulating housing and moving outwards in the second direction to release the card.

Other objects, advantages and novel features of the invention will become more apparent from the following detailed description when taken in conjunction with the accompanying drawings.

DETAILED DESCRIPTION OF THE PREFERRED EMBODIMENT OF THE INVENTION

Reference will now be made to the drawings to describe the present invention in detail.

Figure 1:
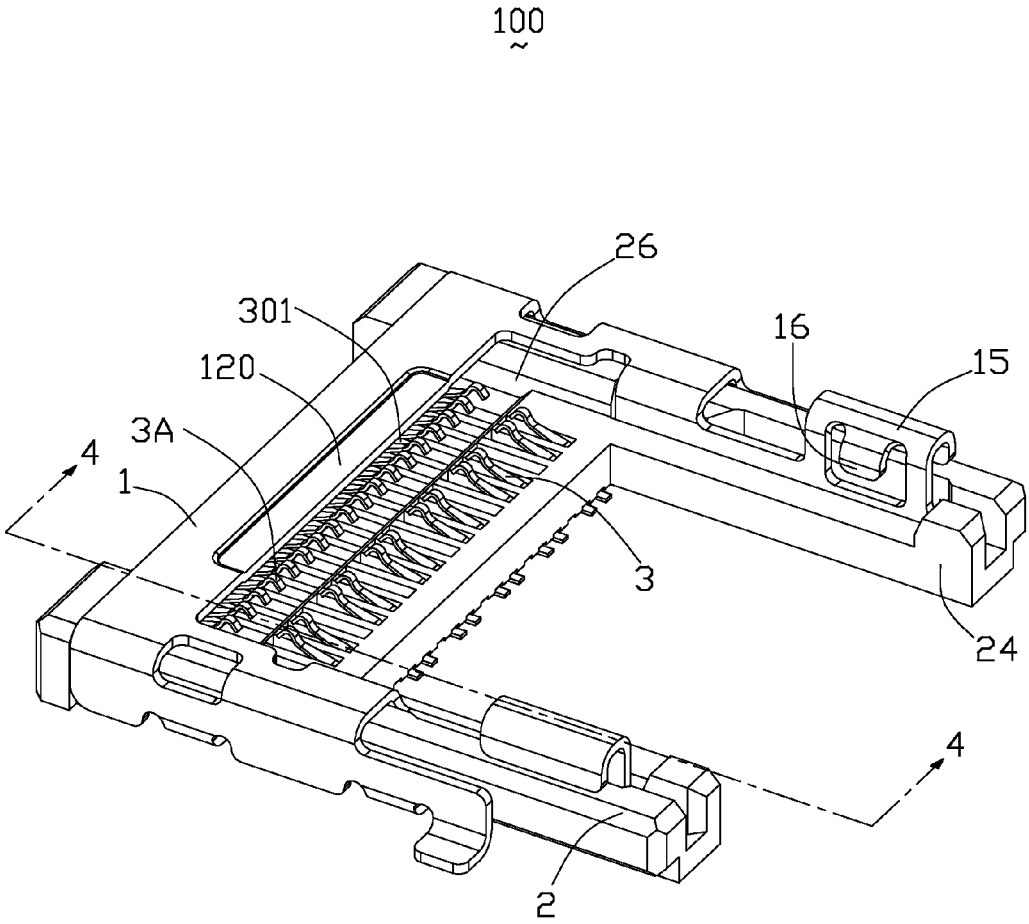
FIG. 1 is a perspective view of an electrical connector in accordance with a preferred embodiment of the present invention.
Figure 4:
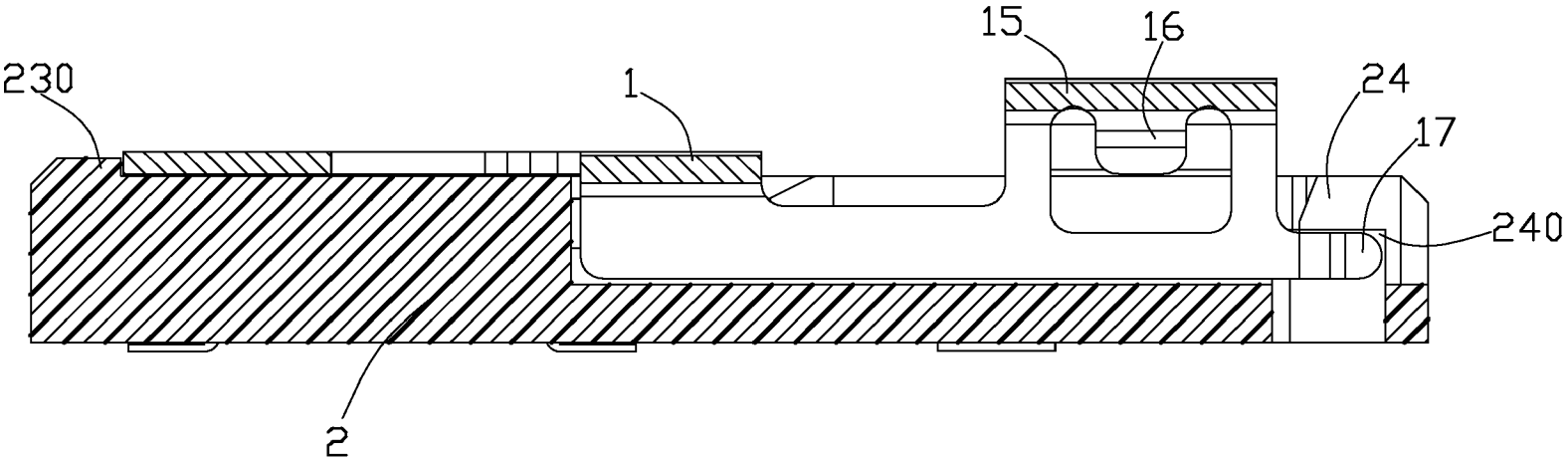
FIG. 4 is a cross sectional view of the electrical connector taken along line 4-4 in FIG. 1.

Referring to FIGS. 1 and 4, an electrical connector 100 in accordance with the present invention is adapted for receiving a card-like component, such as opto-electronic module which is development recently, (hereinafter collectively referred to as card 90). The electrical connector 100 comprises an insulating housing 2, a plurality of terminals 3 retained in the housing and a metal frame 3 covering on the housing to latch and release the card 90 in the housing.

Figure 2:
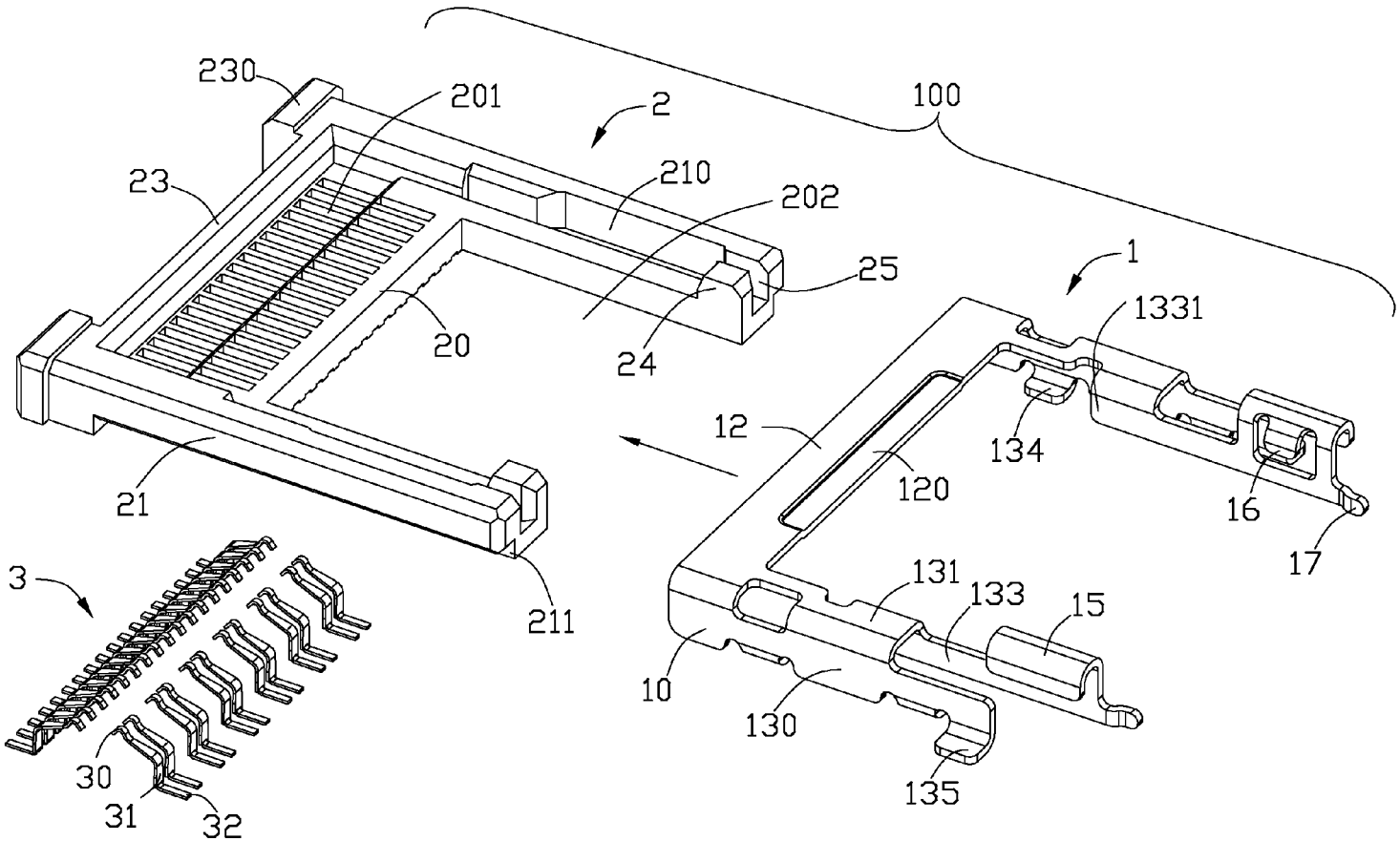
FIG. 2 is an exploded perspective view of the electrical connector.
Figure 3:
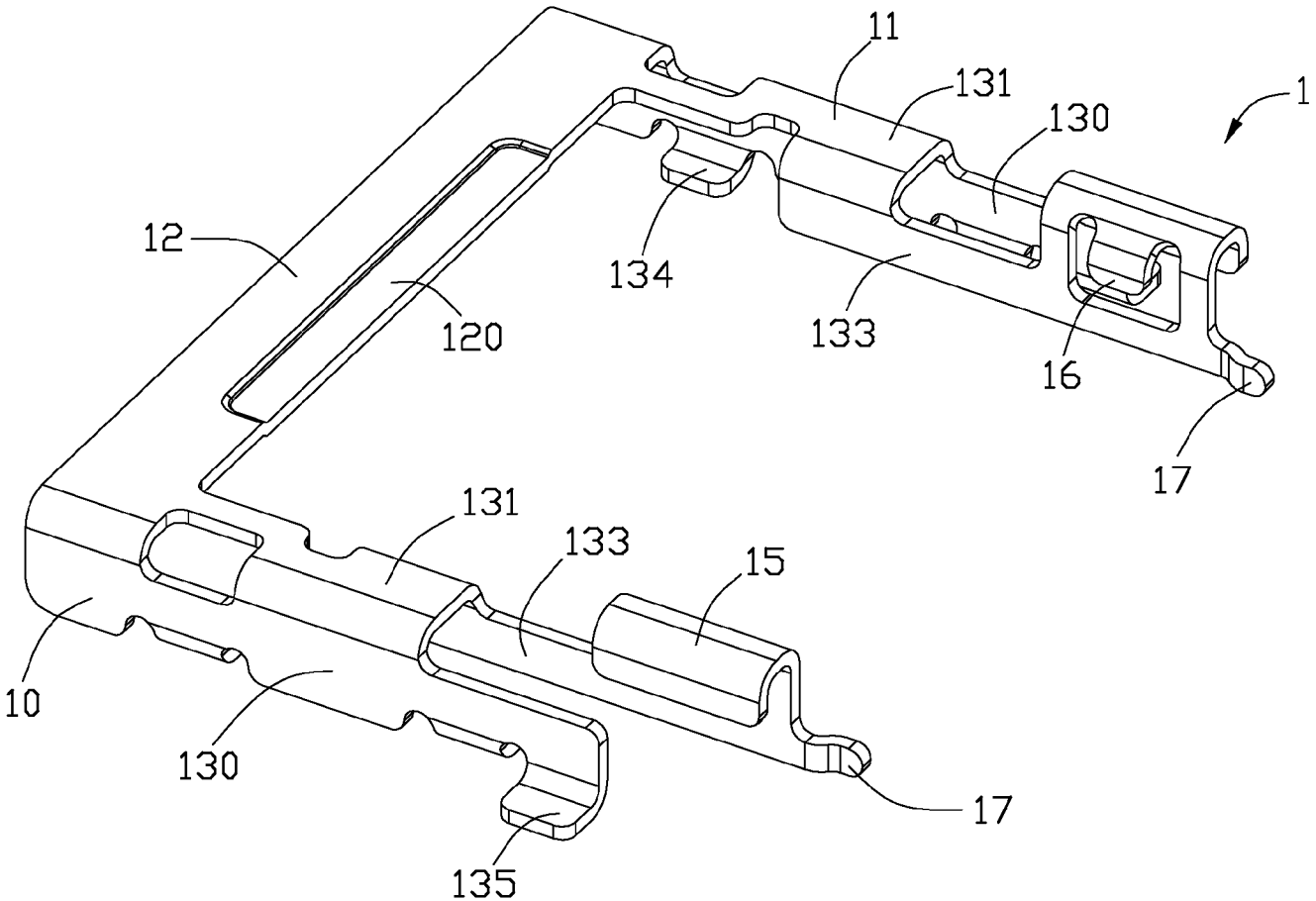
FIG. 3 is an enlarged perspective view of metal frame of the electrical connector.

Referring to FIGS. 1-3, the insulating housing 2 includes a base wall or bottom wall 20 with a rear terminal-located portion 201 and a front larger notch 202 opening forwards. Two sidewalls 21 and a rear wall 23 extend perpendicularly from three edges of the base wall 20. The sidewalls extend in a first direction. The terminals are divided in two rows and lined in the terminal location portion 26 between said two sidewalls 21 along a second direction perpendicular to the first direction. The retaining sections 31 are retained in the base wall 20, the contacting sections 30 extend above the bottom wall 20 and the soldering sections 32 expose to the bottom face of the housing. Said two rows of the terminals 3 follow in an opposite direction along the first direction and the contacting sections face to face.

The metal fame 3 is formed by stamping and bending a metal plate, which is construed from a base portion 12 and a pair of side arms 10 extending from two ends of the base portion 12. Each side arm 10 includes two parallel vertical portions 130, 133 and a horizontal portion 131 connecting with said vertical portions. After the metal frame slides to the housing along the first direction, the base wall 12 cover on the rear wall 23 and portions over the terminal-location portion 201 to deform a receiving slot 301. The width of base portion in the first direction is dimensioned to not exceed the terminal-location portion 201 in the first direction so as to be suitable for the insertion of the card 90, in a preferred embodiment, the base portion 12 do not exceed the rear row of the terminals 3A. The outer vertical portions 130 abut against the outer faces of the side walls 21 and the horizontal portions 131 is on the top face of the side walls 21, and two retaining tabs 134 bending inwards from the outer vertical portion 130 slide into a groove 211 on the insertion of the outer face and bottom face of the side walls of the housing so that the metal frame 1 is retained on the housing. The projections 230 on the top of the rear wall are used for protecting the metal frame 1. A soldering portion 135 bends outwards from the outer vertical portion 130.

The base wall 20 projects a locking post 24 near to a front of the notch 202, which is adjacent to the side arm 21. A slit slot (not labeled) is construed at the intersection of each side wall 21 and the base wall 20 and the middle portion of each side wall 21 is recessed inward from the slit slot thereof to define a moving recess 210. The sliding slot runs through a front edge of the housing, i.e., the post 24 separates from the side arm by the slot 25. The inner vertical portions 133 slide into the slots and can move outwards in the second direction by urging (with spring elasticity). A handing portion 15 extend upright from the top edge of the inner vertical portion 133 and then bending down at the outside. Each handing portion 15 has a locking portion 16 formed in the middle thereof which extend downwards freely with an inwards-slant tip. An abutting portion 17 extends forwards and inwards from the front bottom edge of the inner vertical portion 15, which abuts against a shadow recess 240 defined on the post 24 so that the metal frame 1 can be prevented from separating from the side wall 21 in the first direction. The rear ends 1331 of the inner vertical portion 133 are pressed against the sidewall to provide a pivot point when the hander portions 15 are urged to shift outwards in the second direction.

Figure 5:
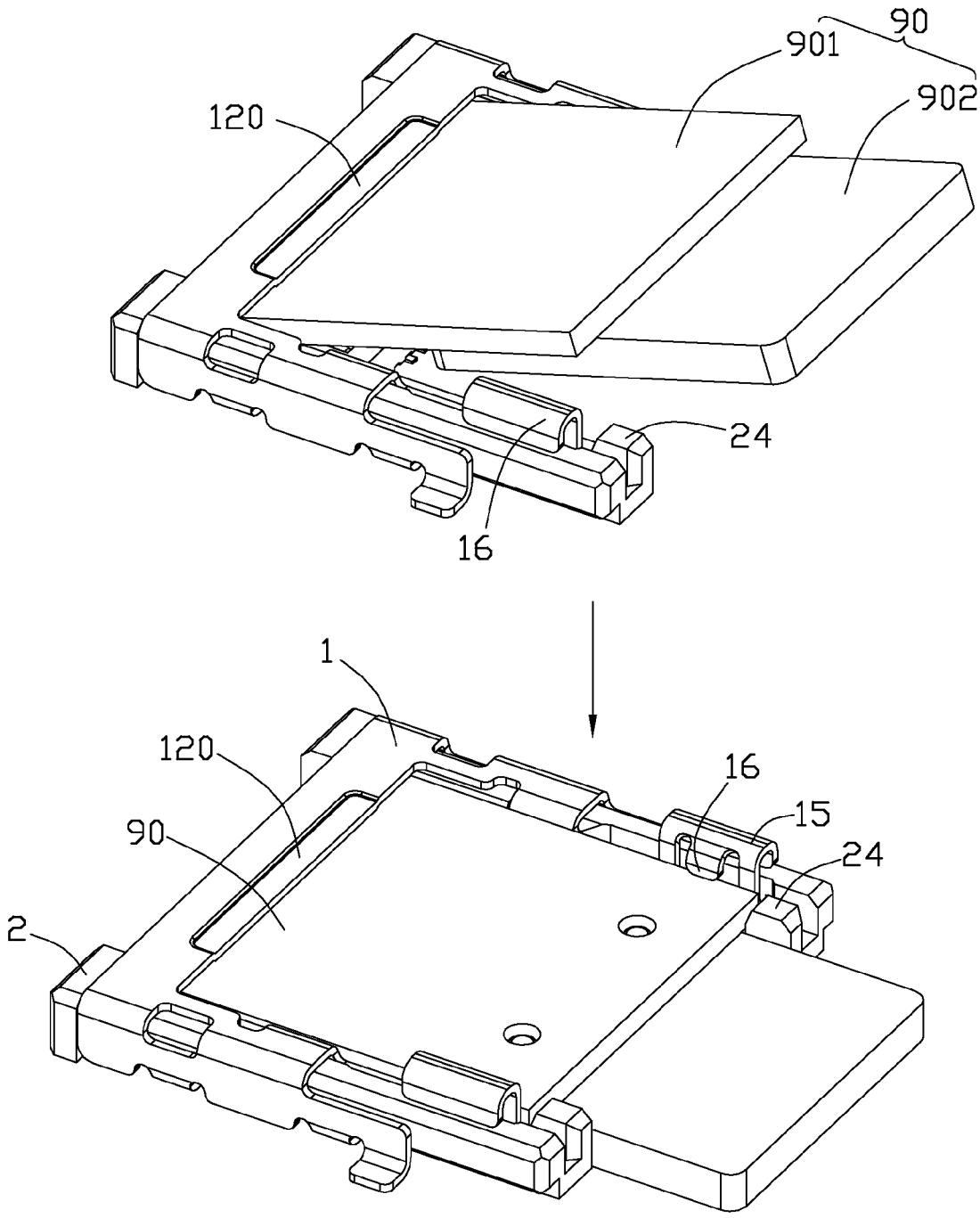
FIG. 5 is an isometric view of the assembly of the card into the electrical connector.

Referring to FIG. 5 combination with FIG. 1, the card 90 includes two layer portions, an upper layer potion 901 and a lower layer portion 902, and the upper layer portion 901 has two row conductive pads (not shown) on the bottom face of the front mating end thereof. Firstly, the upper layer 901 of the card is slantwise inserted in the receiving slot 301 and then the card rotates downwards about the front end of the card until the upper layer portion seats on the base wall 20 and the lower portion 902 is received in the notch 202. The projection posts 24 are located at the rear end of the card to limit the card in the first direction. The conductive pads are mechanical contacted with contacting sections of the terminals. During rotation of the card 90, the side edges of the card 90 press against the locking portion 16 to urge the locking portion 16 and the inner vertical portion 133 to move outwards until the side edges of the card slides go across the locking portion 16. Then the inner vertical portions 133 restore and the locking portions press against the top face of the upper layer portion 901 to limit the card moving in third direction perpendicular to the first and second directions. The middle portion 120 of the base portion 12 is stamped downwards, which will increase the elasticity of the base portion 12 and benefit the engagement of the conductive pads and terminals.

The card is released from the housing by a manner that the handle portions 16 are urged to shift outwards and the card is detached from the locking portions.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for receiving a card, comprising:

an insulating housing comprising a base having a terminal-location portion, a pair of sidewalls extending along a first direction and a rear wall adjacent to the terminal-location portion;

a plurality of terminals arranged in the terminal-location portion along a second direction perpendicular to the first direction;

a metal frame attached to the insulating housing, comprising a base portion located above the terminal-location portion to define a receiving slot between the terminal-location portion and the base portion for receiving a mating end of the card;

the metal frame further comprising a pair of locking portions adapted for pressing against a top face of the card to lock the card in the insulating housing and moving outwards in the second direction to release the card.

2. The electrical connector as claimed in claim 1, wherein the base wall of the insulating housing includes a pair of projection posts behind the card to limit the card from moving in the first direction.

3. The electrical connector as claimed in claim 2, wherein the metal frame comprising a pair of side arms extending from two ends of the base portion, each side arm comprising an outer vertical portion, inner vertical portion parallel to the outer vertical portion and a horizontal portion connecting with said two vertical portions, each sidewall of the insulating housing defines a recess to allow the inner vertical portion to move in the second direction, the locking portions are formed on the inner vertical portions.

4. The electrical connector as claimed in claim 3, wherein the outer vertical portions are abutting against outer faces of the sidewalls of the insulating housing.

5. The electrical connector as claimed in claim 4, wherein each of the inner vertical defines an abutting tab at free end thereof which presses against a recess on the post to retain the metal frame in the first direction.

6. The electrical connector as claimed in claim 1, wherein the base portion of the metal frame is formed by stamping downwards at a middle portion thereof.

7. An electrical connector comprising:

an insulative housing defining a terminal location portion with a mating face facing toward an exterior in a vertical direction;

a plurality of contacts disposed in the terminal location portion with contacting sections upwardly extending above said mating face; and a unitary metallic frame assembled to the housing and essentially defining, in a top view, a U-shaped configuration and a base portion spaced from the mating face with a space between the base portion and the terminal location portion, and a pair of side arms extending forwardly from two opposite ends of the base portion; wherein each of said side arms is equipped with a locking portion which is moveable in a lateral direction perpendicular to said vertical direction for locking/unlocking an electronic module whose front end region is received in the space and which is loaded unto or unloaded from the housing in a rotational manner about said front end region.

8. The electrical connector as claimed in claim 7, wherein said insulative housing further includes a pair of supporting arms extending forwardly around two opposite ends of the terminal location portion.

9. The electrical connector as claimed in claim 8, wherein each of said pair of supporting arms defines an upward supporting face for supporting said electronic module.

10. The electrical connector as claimed in claim 9, wherein each of said pair of supporting arms defines a front stopper for restricting forward movement of the electronic module.

11. The electrical connector as claimed in claim 8, wherein the side arms of said metallic frame are assembled to the corresponding supporting arms along a front-to-back direction perpendicular to both said vertical section and said lateral direction.

* * * * *